US005871170A

United States Patent [19]

Morales et al.

[11] Patent Number: 5,871,170

[45] Date of Patent: Feb. 16, 1999

[54] TELESCOPIC PAPER ROLL HOLDER

[76] Inventors: Antonio Morales; Luis M. Peña, both of 7221 NW. 3 St., Miami, Fla. 33126

[21] Appl. No.: 949,167

[22] Filed: Oct. 10, 1997

[51] Int. Cl.[6] ..... B65H 16/02; B65H 16/04; B65H 16/06

[52] U.S. Cl. ..... 242/592; 242/597.5; 242/598.2; 242/599.1; 242/599.2

[58] Field of Search ..... 242/591, 592, 242/597.5, 598.2, 599.1, 599.3, 599.2

[56] References Cited

U.S. PATENT DOCUMENTS

| | | | |
|---|---|---|---|
| 1,665,738 | 4/1928 | Hoegger | 242/598.2 |
| 2,517,809 | 8/1950 | Tarzian | 242/599.1 |
| 2,801,809 | 8/1957 | Glaner | 242/599.1 |
| 3,923,265 | 12/1975 | Krueger et al. | 242/597.5 |
| 4,741,486 | 5/1988 | Ancona et al. | 242/597.4 |
| 5,718,396 | 2/1998 | Maresca | 242/598.2 |

*Primary Examiner*—John Q. Nguyen
*Attorney, Agent, or Firm*—J. Sanchelima

[57] ABSTRACT

A holder for paper rolls that include a centrally disposed through opening. A pivotally and rotably mounted telescopic tubular assembly holds to paper roll through the opening and includes other articulations that permit the selective pivoting movements of different telescopic sections to position the paper roll at the most convenient position. The holder is mounted to a flat surface by two spaced apart support assemblies. The telescopic tubular assembly includes at least two pivotally connected tubular members housed within each other. The outer tubular member holds the paper roll.

5 Claims, 2 Drawing Sheets

TELESCOPIC PAPER ROLL HOLDER

BACKGROUND OF THE INVENTION

1. Field of the Invention

The present invention relates to a paper roll holder, and more particularly, to the type in which the paper roll can be telescopically positioned in different places.

2. Description of the Related Art

Many holders for paper rolls, such as toilet papers rolls and towel paper rolls, exist. Typically, these designs are intended to rotably secure the paper roll in a minimum of space available. One of these designs is shown in U.S. Pat. No. 4,741,846 issued to the Anconas in 1988. While the Anconas' holder permits a user to position the roll in either a horizontal or vertical position, it lacks the features of telescopically extending the position of the paper roll as described and claimed in the present application.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a paper roll holder wherein the paper roll can be telescopically moved to different positions.

It is another object of this invention to provide a telescopic paper roll holder that includes pivoting members that facilitate a user the positioning of the paper roll for easy access, which is specially helpful for the handicapped.

It is still another object of the present invention to provide a holder that is structurally sound permitting the reliable rotably support of the paper roll.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1A:
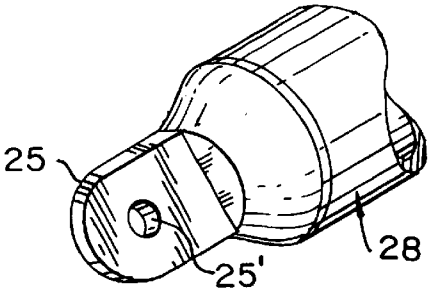
FIG. 1A shows a partial detailed view of one end of tubular assembly 20.

Referring now to the drawings, where the present invention is generally referred to with numeral 10, it can be observed that it basically includes telescopic assembly 15 pivotally mounted to supporting assembly 60, at one end, and the other end being removably mounted to supporting assembly 70. Paper roll R is of the conventional type that includes a cylindrical core that defines a through opening O and the paper is rolled on the cylindrical core.

Figure 1:
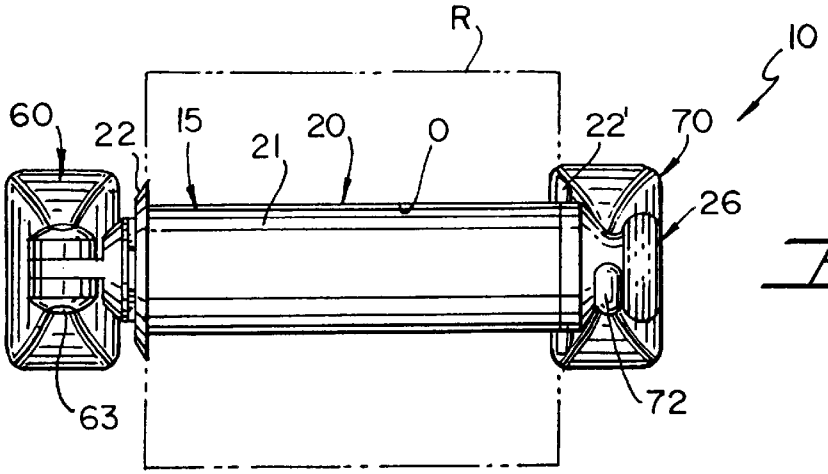
FIG. 1 is an elevational front view of one of the embodiments for the present invention mounted horizontally with a paper roll in phantom mounted thereon.
Figure 3A:
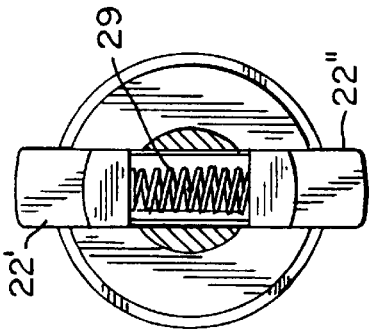
FIG. 3A is a partial cross-sectional view of the distal end of the outer tubular assembly.
Figure 5:
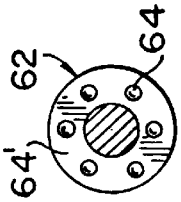
FIG. 5 is an end view of the supporting assembly, taken along line 5—5 shown in FIG. 4.

In FIG. 1 telescopic assembly 15 of device 10 is illustrated in retracted position as it is seen in conventional holders. Outer tubular assembly 20 is shown with paper roll R rotably mounted thereon. Assembly 20 is held in place by supporting assemblies 60 and 70. Outer tubular assembly 20 snugly fits over tubular member 30 that in turn snugly houses tubular member 40 which in turn snugly houses tubular member 50. Outer tubular assembly 20 includes cylindrical member 21 with flange wall 22 and spring loaded chamfered stopper pins 22' and 22" mounted to its distal ends thereby keeping paper roll R in place. When inserting a new paper roll, the core hits the curved outer surface of stopper pin 22' and 22" causing then to cammingly travel inwardly the force of spring 29, as best seen in FIG. 3A. Outer tubular assembly 20 includes also annular groove 24 that is located adjacent to one end of assembly 20. Groove 24 is designed to rest on bearing hook 72 of assembly 70 that is fastened to a selected surface, typically a vertically surface but not necessarily so.

Figure 2:
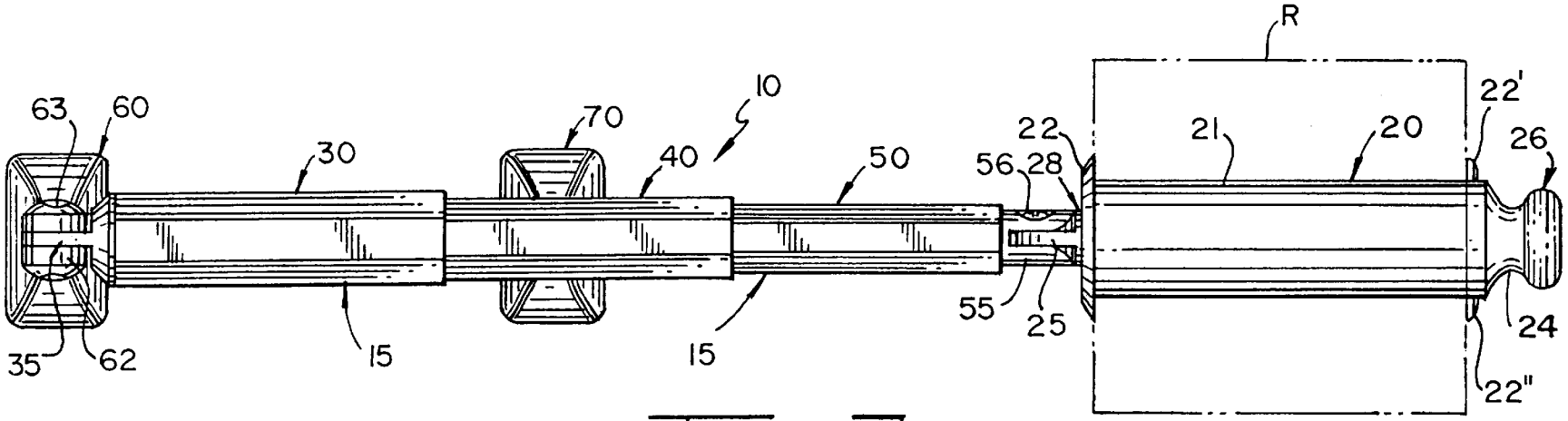
FIG. 2 is an elevational front view of the paper roll holder shown in FIG. 1 telescopically extended and the paper roll shown in phantom.

Assembly 20, in the preferred embodiment, is pivotally mounted to tubular member 50 through tab member 25 that is cooperatively received by fork member 55 rigidly mounted to one end of member 50, as seen in FIG. 2. Pin 56 passes through opening 25'. Tab member 25 is rigidly mounted to shaft 28 which in turn is mounted inside tubular member 21 of assembly 20, as shown in FIG. 1A.

Figure 4:
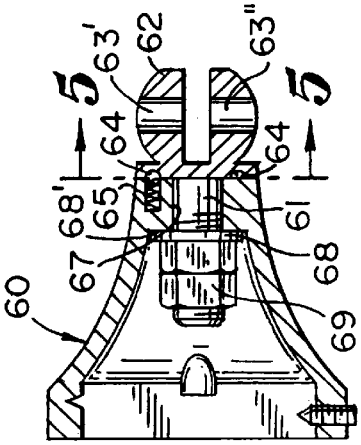
FIG. 4 is a an elevational partial cross section, taken along line 4—4 in FIG. 3, of one of the supporting assemblies of the paper roll holder.
Figure 3:
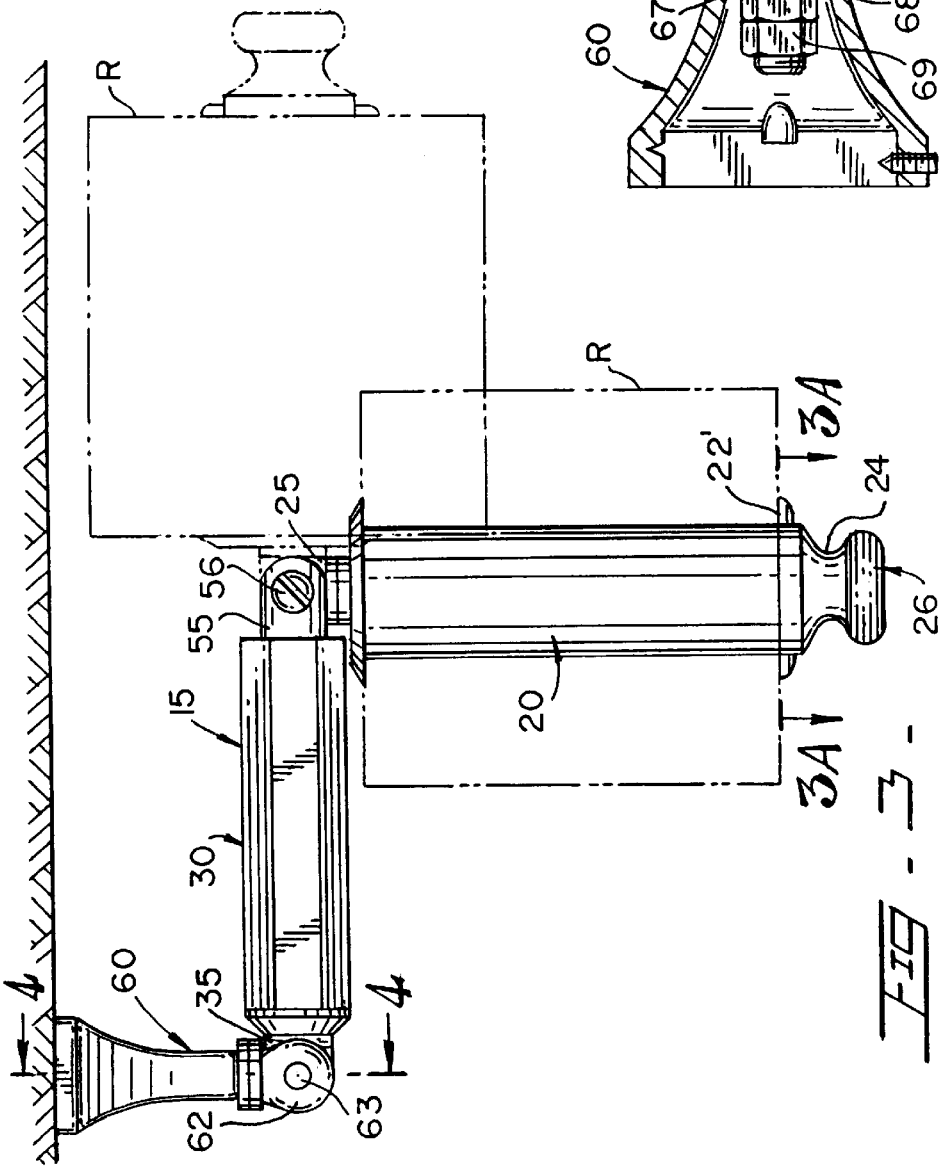
FIG. 3 is a top view of this invention, showing the paper roll holder partially extended and at a 90 degrees angle with respect to the surface on which the holder is mounted.

Tubular assembly 30, in the preferred embodiment, is pivotally mounted, at one end, to supporting assembly 60 through tab member 35. Tab member 35 is cooperatively received by fork member 62 of supporting assembly 60 by pin 63 passing through openings 63' and 63" of assembly 60, as seen in FIG. 4. Typically, a spindle for a paper roll is rigidly positioned in parallel relationship with respect to a wall whereto a holder is fastened. However, device 10 includes a pivoting joint comprising tab member 35, fork member 62 and pin 63 that permits a user to pivot telescopic assembly 15 from horizontal to vertical position or any position inbetween. This is possible also because annular groove 24 is removably supported by bearing hook 72. A user can easily manipulate outer tubular assembly 20 by unhooking member 26. Device 10 also includes a second pivoting joint comprising tab member 25, fork member 55 and pin 56 that permits a user to pivot outer tubular assembly 20 from a horizontal to vertical position, or any position in inbetween, with respect tubular assembly 30, as shown in FIG. 3. Outer tubular assembly 20 pivots about pin 56 only when assembly 20 is outwardly and telescopically extended thereby exposing the second pivoting joint assembly.

Fork member 62 is rotably mounted to the free end of assembly 60. Threaded shank 61 extends centrally inwardly through bore 67. Washer 68 is pushed against shoulder 68' when fork member 62 is rotated causing shank 61 to advance through nuts 69. Fork member 62, in the preferred embodiment, has recesses 64 located in flat surface 64'. Recesses 64 are designed to selectively receive spring loaded pin 65, as best seen in FIG. 4. In this manner, telescopic assembly 15 can be rotated to a selected position, that is defined by the location of pin 65 and recesses 64.

When a user is distant from paper roll R, or access is difficult, specially for handicapped people, outer tubular assembly 20 is unhooked and pulled away/outwardly thereby telescopically extending tubular members 30; 40 and 50. The overall length of telescopic assembly 15 depends on the number of tubular assemblies added and needs of a user.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A holder for a paper roll that includes a centrally disposed through opening and said holder being mounted to a flat surface, comprising:

A) first supporting means non-movably mounted to said surface;

B) telescopic means for rotatably holding said paper roll, said telescopic means having first and second ends, said first end being pivotally and rotatably mounted to said first supporting means so that said paper roll can be selectively positioned at a desired position away from said surface and said telescopic means including at least two tubular members fully telescopically and snugly housed within each other and an outer tubular member that telescopes fully over said two tubular members and that rotatably holds said paper roll; and C) second supporting means mounted to said surface at a cooperative space apart relationship with respect to said first supporting means, and further including bearing hook means for removably supporting said second end.

2. The holder set forth in claim 1 wherein said telescopic means includes an inner tubular member that pivots about an axis perpendicular to the axis of said outer tubular member.

3. The holder set forth in claim 2 wherein said outer tubular member includes two ends and means for removably holding said paper roll mounted to said outer tubular member.

4. The holder set forth in claim 3 wherein said means for removably holding said paper roll includes at least one spring loaded chamfered stopper pin that permits the insertion of said paper roll by applying a predetermined force while requiring a user to actuate said stopper pin before said paper roll can be removed.

5. The holder set forth in claim 4 wherein said second end of said telescopic assembly includes a fork member with a through opening and said outer tubular member includes a cooperating tab with an opening that is aligned with said through opening, said tab being positioned within the fork member and further including a pin inserted through said tab opening and said through opening so that said outer tubular member is pivotally mounted to said second end.

* * * * *